US008577238B2

(12) United States Patent
Ogawahara et al.

(10) Patent No.: US 8,577,238 B2
(45) Date of Patent: Nov. 5, 2013

(54) FIXING DEVICE AND IMAGE FORMING APPARATUS

(75) Inventors: Norio Ogawahara, Kanagawa (JP); Yasuyuki Kobayashi, Kanagawa (JP); Masaki Nagata, Kanagawa (JP); Kouichi Imazu, Kanagawa (JP); Keiji Miba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 313 days.

(21) Appl. No.: 13/008,347

(22) Filed: Jan. 18, 2011

(65) Prior Publication Data

US 2011/0318037 A1 Dec. 29, 2011

(30) Foreign Application Priority Data

Jun. 28, 2010 (JP) ..... 2010-146925

(51) Int. Cl.
*G03G 15/20* (2006.01)

(52) U.S. Cl.
USPC ..... 399/68; 399/67; 399/69; 399/332

(58) Field of Classification Search
USPC ..... 399/67–69, 332
See application file for complete search history.

(56) References Cited

U.S. PATENT DOCUMENTS

| | | | | |
|---|---|---|---|---|
| 4,079,227 | A | 3/1978 | Takiguchi | |
| 2006/0251439 | A1 | 11/2006 | Sugiyama | |
| 2007/0264059 | A1 * | 11/2007 | Maeda et al. | 399/320 |

FOREIGN PATENT DOCUMENTS

| | | | |
|---|---|---|---|
| JP | 54-032336 | B | 10/1979 |
| JP | 59-34314 | B | 8/1984 |
| JP | 9-160315 | | 6/1997 |
| JP | 10-149044 | | 6/1998 |
| JP | 2006-243377 | | 9/2006 |
| JP | 2006-308644 | | 11/2006 |
| JP | 2006-337994 | | 12/2006 |

* cited by examiner

*Primary Examiner* — Ryan Walsh
(74) *Attorney, Agent, or Firm* — Sughrue Mion, PLLC

(57) ABSTRACT

There is provided a fixing device including: a heating member that, while rotating, heats and fixes a developer image onto a recording medium; a pressing member that nips and presses the recording medium between itself and the heating member; an external heating member configured to make contact with an outer surface of the heating member and to move away from the outer surface of the heating member, the external heating member making contact with the outer surface of the heating member and heating the heating member; and a moving section that computes a contact position of a leading edge of the recording medium and the outer surface of the heating member, and moves the external heating member such that the external heating member contacts the outer surface of the heating member based on the computed position.

5 Claims, 8 Drawing Sheets

FIXING DEVICE AND IMAGE FORMING APPARATUS

CROSS-REFERENCE TO RELATED APPLICATION

This application is based on and claims priority under 35 USC 119 from Japanese Patent Application No. 2010-146925 filed on Jun. 28, 2010.

BACKGROUND

Technical Field

The present invention relates to a fixing device and an image forming apparatus.

SUMMARY

According to an aspect of the invention, there is provided a fixing device including: a heating member that, while rotating, heats and fixes a developer image onto a recording medium; a pressing member that nips and presses the recording medium between itself and the heating member; an external heating member configured to make contact with an outer surface of the heating member and to move away from the outer surface of the heating member, the external heating member making contact with the outer surface of the heating member and heating the heating member; and a moving section that computes a contact position of a leading edge of the recording medium and the outer surface of the heating member, and moves the external heating member such that the external heating member contacts the outer surface of the heating member based on the computed position.

BRIEF DESCRIPTION OF THE DRAWINGS

Exemplary embodiments of the present invention will be described in detail based on the following figures, wherein.

DETAILED DESCRIPTION

Explanation follows regarding an example of a fixing device and an image forming apparatus according to an exemplary embodiment of the present invention.

Figure 1:
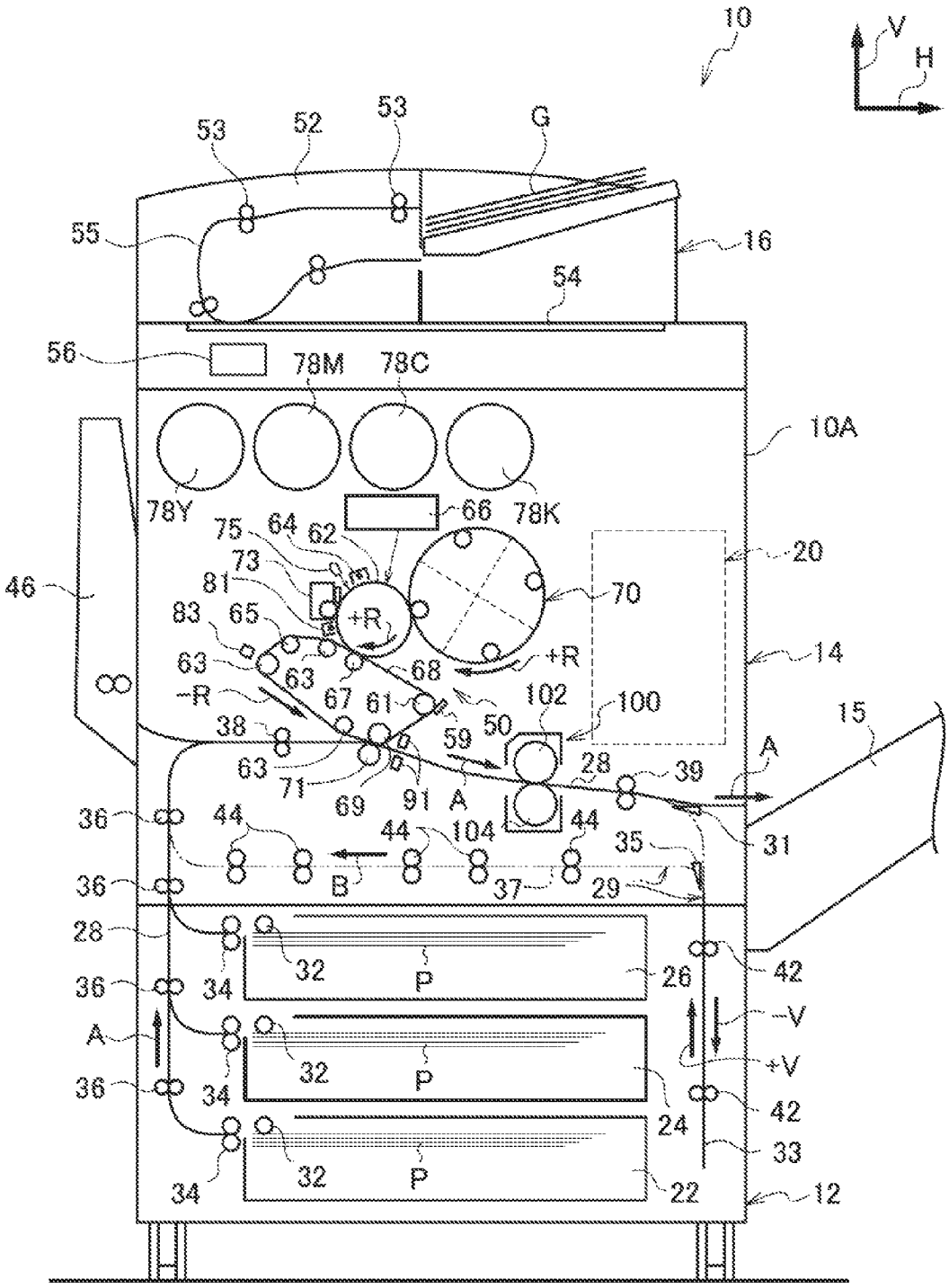
FIG. 1 is an overall configuration diagram of the image forming apparatus according to an exemplary embodiment of the present invention.

FIG. 1 shows an image forming apparatus 10 as an exemplary embodiment. The image forming apparatus 10 is configured including, from the bottom towards the top in the vertical direction (direction of arrow V): a paper housing section 12 that houses recording paper P; an image forming section 14 provided above the paper housing section 12 and performing image forming on the recording paper P, serving as an example of a recording medium and supplied from the paper housing section 12; an original scanning section 16 provided above the image forming section 14 for scanning an scanning original G; and a control section 20, serving as an example of a speed changing section provided in the image forming section 14 and controlling operation of each section of the image forming apparatus 10 and changing the movement speed (conveying speed) of the recording paper P. In the following explanation, the vertical direction of an apparatus main body 10A of the image forming apparatus 10 is referred to as the arrow V direction, and the horizontal direction is referred to as the arrow H direction.

The paper housing section 12 is provided with a first housing section 22, a second housing section 24, and a third housing section 26 housing different sizes of the recording paper P. Feed rolls 32 are provided in the first housing section 22, the second housing section 24, and the third housing section 26, respectively, for feeding out the housed recording paper P to a conveying path 28 provided within the image forming apparatus 10. Pairs of conveying rolls 34 and conveying rolls 36 are provided at the downstream side of the feed rolls 32 on the conveying path 28, for conveying the recording paper P one sheet at a time. Positioning rolls 38 are provided on the conveying path 28 downstream of the conveying rolls 36 in the recording paper P conveying direction, for temporarily stopping the recording paper P and feeding the recording paper P out to a secondary transfer position QB (see FIG. 2), described below, at a particular timing.

The upstream portion of the conveying path 28 (a location where the conveying rolls 36 are provided), as viewed from the front face of the image forming apparatus 10, is provided in a straight line along the arrow V direction from the left hand side of the paper housing section 12 to a left hand side lower portion of the image forming section 14. The downstream portion of the conveying path 28 is provided from the left hand side lower portion of the image forming section 14 up to a paper discharge section 15 provided at the right hand face of the image forming section 14. A double-sided conveying path 29 is connected to the conveying path 28, for conveying and reversing the recording paper P in order to perform image forming on both sides of the recording paper P.

The double-sided conveying path 29 has, when viewed from the front face of the image forming apparatus 10: a first switching member 31 that switches between the conveying path 28 and the double-sided conveying path 29; a reversing section 33 provided in a straight line along the arrow V direction (−V denotes downwards and +V denotes upwards in the drawing) from a right hand side lower portion of the image forming section 14 to the right hand side of the paper housing section 12; a conveying section 37 that conveys the recording paper P in the arrow H direction towards the right hand side in the drawing so that the trailing edge of the recording paper P conveyed into the reversing section 33 is leading; and a second switching member 35 that switches between the reversing section 33 and the conveying section 37. Pairs of conveying rolls 42 are provided at plural locations at intervals in the reversing section 33 and pairs of conveying rolls 44 are provided at plural locations at intervals in the conveying section 37.

The first switching member 31 is a triangular pillar shaped member configured so as to switch the conveying direction of the recording paper P by the leading end portion of the first switching member 31 being moved by a drive unit (not shown in the drawings) between one or other of the conveying path 28 or the double-sided conveying path 29. Similarly, the second switching member 35 is a triangular pillar shaped member as viewed from the front face, configured so as to switch the conveying direction of the recording paper P by the leading end portion of the second switching member 35 being moved by a drive unit, not shown in the drawings, between one or other of the reversing section 33 or the conveying section 37. The downstream end portion of the conveying section 37 is connected by a guide member (not shown in the drawings) to a position just in front of the conveying rolls 36 on the upstream portion of the conveying path 28. A foldable manual paper feed section 46 is also provided to the left hand face of the image forming section 14, and conveying path of recording paper P fed in from the manual paper feed section 46 is connected to the conveying path 28 just in front of (just upstream of) the positioning rolls 38.

The original scanning section 16 is provided with: an original conveying device 52 that automatically conveys a scan original G one sheet at a time; a platen glass 54, disposed downstream of the original conveying device 52 and on which a single sheet of scan original G is placed; and an original scanning device 56 that scans the scan original G conveyed by the original conveying device 52 or the scan original G placed on the platen glass 54.

The original conveying device 52 has an automatic conveying path 55 on which plural pairs of conveying rolls 53 are disposed, and a portion of the automatic conveying path 55 is disposed such that the scan original G passes across the platen glass 54. The original scanning device 56 scans in a stationary state at the left hand end portion of the platen glass 54 the scan original G that has been conveyed by the original conveying device 52, or scans in the scan original G that has been placed on the platen glass 54 while moving in the arrow H direction.

The image forming section 14 has an image forming unit 50, serving as an example of a developer image forming section, that forms a toner image (developer image) on the recording paper P. The image forming unit 50 is configured including a photoreceptor 62, a charging member 64, a light-exposing device 66, a developing device 70, an intermediate transfer belt 68, and a cleaning device 73, as described below.

The image forming section 14 is provided with the circular cylinder shaped photoreceptor 62, serving as an example of a latent image holding body, at a central portion of the apparatus main body 10A. The photoreceptor 62 is configured so as to be rotated in the arrow +R direction (the clockwise direction in the drawing) by driving with a drive section (not shown in the drawings) and to hold an electrostatic latent image formed by illuminating light thereon. The corotron charging member 64 is provided at a position above the photoreceptor 62 and facing the outer surface of the photoreceptor 62, for charging the surface of the photoreceptor 62.

The light-exposing device 66 is provided at a position downstream of the charging member 64 in the photoreceptor 62 rotation direction and facing the outer surface of the photoreceptor 62. The light-exposing device 66 includes a semiconductor laser, an f–θ lens, a polygon mirror, an imaging lens, and plural mirrors, not shown in the drawings. The light-exposing device 66 is configured to form an electrostatic latent image by deflection-scanning with the polygon mirror a laser beam emitted from the semiconductor laser based on an image signal, and to illuminate (expose) the outer surface of the photoreceptor 62 that has been charged by the charging member 64. Note that the light-exposing device 66 is not limited to the method of scanning a laser beam using a polygon mirror, and a Light Emitting Diodes (LED) method may be employed.

A developing device 70 is provided downstream in the photoreceptor 62 rotation direction of the illumination position of exposure light from the light-exposing device 66. The developing device 70 is a rotation-switch-over device that develops an electrostatic latent image formed on the outer surface of the photoreceptor 62 with a given color of toner and makes the electrostatic latent image visible.

Figure 2:
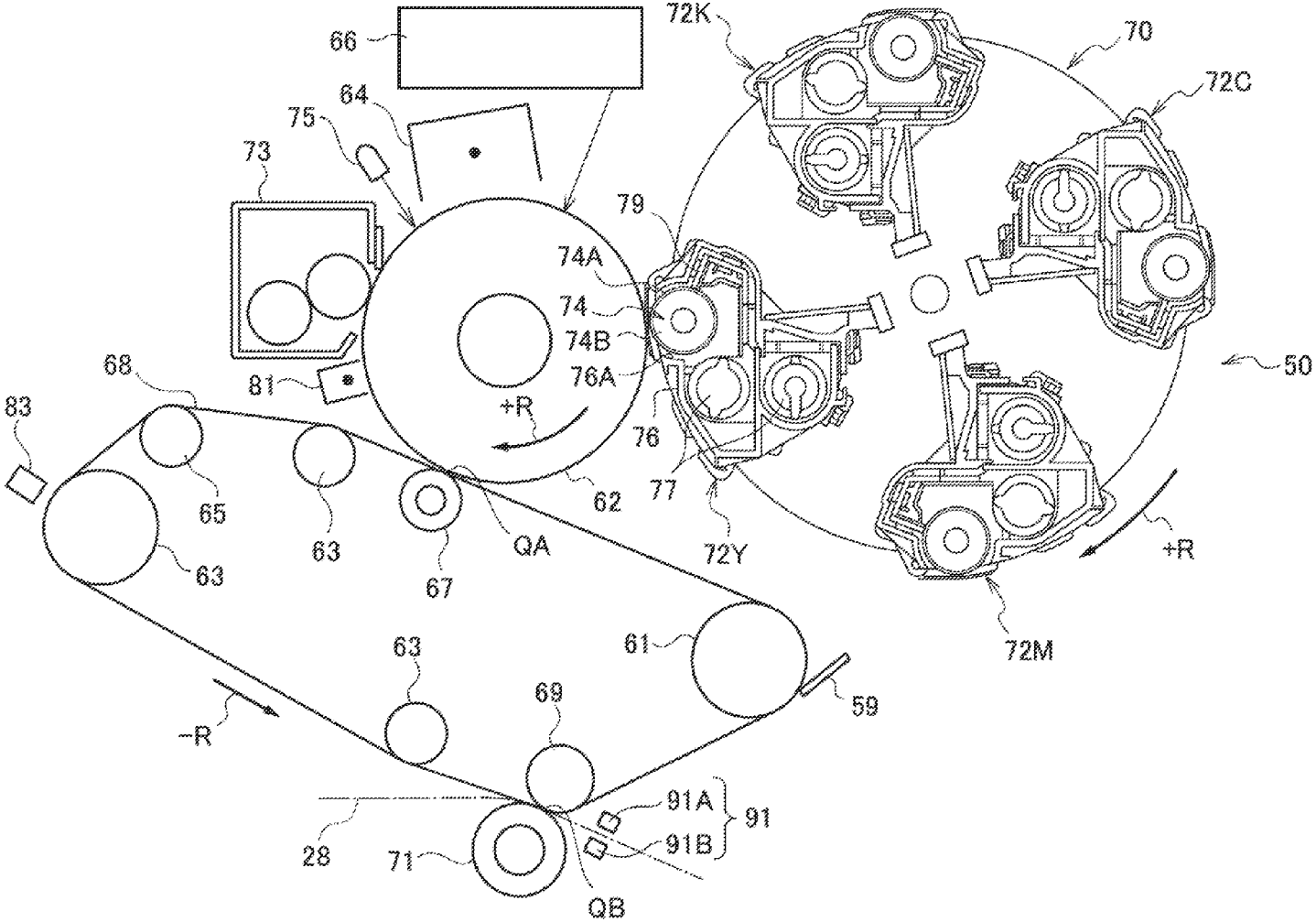
FIG. 2 is a configuration diagram of an image forming unit according to the exemplary embodiment of the present invention.

As shown in FIG. 2, the developing device 70 has developer units 72Y, 72M, 72C, 72K disposed in a row (in this sequence in the anticlockwise direction in the drawing) along the peripheral direction of the developing device 70, corresponding to each of the toner colors yellow (Y), magenta (M), cyan (C), black (K), respectively. The developer units 72Y, 72M, 72C, 72K are disposed such that whichever of the developer unit 72Y, 72M, 72C, or 72K is performing development processing is switched over to face the outer surface of the photoreceptor 62 by rotating the developing device 70 through a central angle of 90° at a time using a motor (not shown in the drawings).

Note that, since the developer units 72Y, 72M, 72C, 72K are each of a similar configuration, explanation will be given here of developer unit 72Y, and further explanation of the other developer units 72M, 72C, 72K is omitted.

The developer unit 72Y has a case member 76 as the main body, and is filled with a developer (not shown in the drawings), formed from a toner and a carrier. The developer is supplied through a toner supply path (not shown in the drawings) from the toner cartridge 78Y (see FIG. 1) in the case member 76. A rectangular shaped opening 76A is formed in the case member 76 facing the outer surface of the photoreceptor 62, and a developer roll 74 is provided at the opening 76A such that the outer surface of the developer roll 74 faces the outer surface of the photoreceptor 62. A plate shaped metering member 79 for regulating the thickness of developer is provided along the length direction of the opening 76A inside the case member 76 at a position in the vicinity of the opening 76A.

The developer roll 74 is configured including a rotatably provided circular cylindrical shaped developer sleeve 74A and a magnetic member 74B formed from plural magnetic poles fixed to the inside of the developer sleeve 74A. Configuration is made such that a developer layer is formed on the outer surface of the developer sleeve 74A by forming a magnetic brush of developer (carrier) by rotating the developer sleeve 74A, and by regulating the thickness with the metering member 79. The developer layer on the outer surface of the developer sleeve 74A is conveyed by rotation of the developer sleeve 74A to a position facing the photoreceptor 62, and developing is performed by adhering toner according to the latent image (electrostatic latent image) formed on the outer surface of the photoreceptor 62.

Two spiral shaped conveying rollers 77 are also rotatably provided next to each other inside the case member 76. The developer filled in the case member 76 is conveyed in a circulating manner along the axial direction of the developer roll 74 (the length direction of the developer unit 72Y) by rotating the two conveying rollers 77. Note that the 4 developer rolls 74 provided in the developer units 72Y, 72M, 72C, 72K are each disposed around the peripheral direction so as to be separated by a central angle of 90° from the adjacent developer roll 74. Configuration is made such that by switching over the developer unit 72, the next developer roll 74 faces the outer surface of the photoreceptor 62.

As shown in FIG. 2, the intermediate transfer belt 68 is provided further downstream than the developing device 70 in the photoreceptor 62 rotation direction and below the photoreceptor 62. The toner image formed on the outer surface of the photoreceptor 62 is transferred onto the intermediate transfer belt 68. The intermediate transfer belt 68 is of an endless shape entrained around a drive roll 61 that is rotationally driven by a control section 20, a tension imparting roll 65 that imparts tension to the intermediate transfer belt 68, plural conveying rolls 63 that make contact with the reverse face of the intermediate transfer belt 68 and perform following rotation, and an auxiliary roll 69 that makes contact with the reverse face of the intermediate transfer belt 68 at the secondary transfer position QB, described later, and performs rotation following the intermediate transfer belt 68. The intermediate transfer belt 68 is configured so as to undertake circulating motion in the arrow −R direction (the anticlockwise direction in the drawing) by rotating the drive roll 61.

The primary transfer roll 67 is provided at the opposite side of the intermediate transfer belt 68 to that of the photoreceptor 62, with the intermediate transfer belt 68 disposed therebetween. The primary transfer roll 67 primary transfers the toner image formed on the outer surface of the photoreceptor 62 onto the intermediate transfer belt 68. At a position separated to the downstream side in the intermediate transfer belt 68 movement direction from the position at which the photoreceptor 62 makes contact with the intermediate transfer belt 68 (this is referred to as the primary transfer position QA), the primary transfer roll 67 makes contact with the reverse face of the intermediate transfer belt 68. The primary transfer roll 67 has electrical continuity with a power source (not shown in the drawings) and accordingly, due to the potential difference therefrom to the earthed photoreceptor 62, the toner image on the photoreceptor 62 is primary transferred onto the intermediate transfer belt 68.

A secondary transfer roll 71, serving as an example of a secondary transfer section, is provided at the opposite side of the intermediate transfer belt 68 to that of the auxiliary roll 69, with the intermediate transfer belt 68 disposed therebetween. The secondary transfer roll 71 secondary transfers onto the recording paper P the toner image that has been primary transferred onto the intermediate transfer belt 68. The secondary transfer position QB is present between the secondary transfer roll 71 and the auxiliary roll 69, where the toner image is transferred onto the recording paper P. The secondary transfer roll 71 makes contact with the front face of the intermediate transfer belt 68. The secondary transfer roll 71 is earthed, and the toner image on the intermediate transfer belt 68 is secondary transferred onto the recording paper P by the potential difference between the auxiliary roll 69 that has electrical continuity with a power source (not shown in the drawings) and the secondary transfer roll 71. Note that the secondary transfer position QB is set at an intermediate position on the previously described conveying path 28 (see FIG. 1).

A cleaning blade 59 is provided at the opposite side of the intermediate transfer belt 68 to that of the drive roll 61, with the intermediate transfer belt 68 disposed therebetween. The cleaning blade 59 recovers toner remaining on the intermediate transfer belt 68 after secondary transfer. The cleaning blade 59 is attached to a casing (not shown in the drawings) formed with an opening, and configuration is made such that toner scraped off by the leading end portion of the cleaning blade 59 is recovered inside the casing.

A position detection sensor 83 is provided at a position on the periphery of the intermediate transfer belt 68 facing one of the conveying rolls 63. The position detection sensor 83 detects a predetermined reference position on the intermediate transfer belt 68 by detecting a mark (not shown in the drawings) applied to the surface of the intermediate transfer belt 68. The position detection sensor 83 outputs a position detection signal that acts as a reference for start timing of image forming processing. The movement position of the intermediate transfer belt 68 is detected by the position detection sensor 83 receiving light emitted towards the intermediate transfer belt 68 and being reflected by the surface of the mark.

A cleaning device 73 is provided further downstream than the primary transfer roll 67 in the photoreceptor 62 rotation direction. The cleaning device 73 cleans toner and the like remaining on the surface of the photoreceptor 62 that has not been primary transferred onto the intermediate transfer belt 68. The cleaning device 73 is configured to recover remaining toner and the like with a cleaning blade that makes contact with the surface of the photoreceptor 62 and a brush roll.

A corotron 81 is provided upstream of the cleaning device 73 in the photoreceptor 62 rotation direction (further downstream than the primary transfer roll 67). The corotron 81 performs electrical discharge of the toner that has remained on the outer surface of the photoreceptor 62 after primary transfer. An electrical discharge device 75 is provided downstream of the cleaning device 73 in the photoreceptor 62 rotation direction (further upstream than the charging member 64). The electrical discharge device 75 illuminates light onto the outer surface of the photoreceptor 62 to perform electrical discharge.

As shown in FIG. 1, paper sensors 91 are provided on either side of the conveying path 28 at a position downstream of the secondary transfer roll 71 in the conveying direction of the recording paper P (the arrow A direction) and in the vicinity of the secondary transfer roll 71. The paper sensors 91 serve as an example of a detection section that detects that the trailing edge of the recording paper P has exited from the secondary transfer roll 71 (the secondary transfer position QB (see FIG. 2)).

The paper sensors 91 are photo-sensors and, as shown in FIG. 2, are configured including a light generating portion 91A and a light receiving portion 91B disposed facing each other with the conveying path 28 running between. The paper sensors 91 are connected through wiring (not shown in the drawings) to the control section 20 (see FIG. 1). The propagation direction of light from the light generating portion 91A to the light receiving portion 91B is a direction orthogonal to the conveying direction of the recording paper P.

In the paper sensors 91, when there is no recording paper P between the light generating portion 91A and the light receiving portion 91B, the light receiving portion 91B receives light that has been emitted from the light generating portion 91A, and there is a large amount of received light. However, when the recording paper P has entered between the light generating portion 91A and the light receiving portion 91B, due to the light heading towards the light receiving portion 91B being blocked by the recording paper P, the amount of light received by the light receiving portion 91B reduces. Accordingly, the control section 20 (see FIG. 1) is configured to detect the passing timing of the trailing edge of the recording paper P at the secondary transfer roll 71, based on changes in the amount of received light detected by the paper sensors 91.

As shown in FIG. 1, a fixing device 100 is provided downstream of the paper sensors 91 in the recording paper P conveying direction. The fixing device 100 fixes onto the recording paper P the toner image that has been transferred onto the recording paper P by the secondary transfer roll 71. Details regarding the fixing device 100 are described below. Conveying rolls 39 are provided further downstream in the recording paper P conveying direction than the fixing device 100, for conveying the recording paper P towards a discharge section 15 or the reversing section 33.

Toner cartridges 78Y, 78M, 78C, 78K containing each of the toners, respectively yellow (Y), magenta (M), cyan (C) and black (K), are exchangeably provided next to each other in a row along the arrow H direction below the original scanning device 56 and above the developing device 70.

Explanation now follows regarding the fixing device 100.

Figure 3:
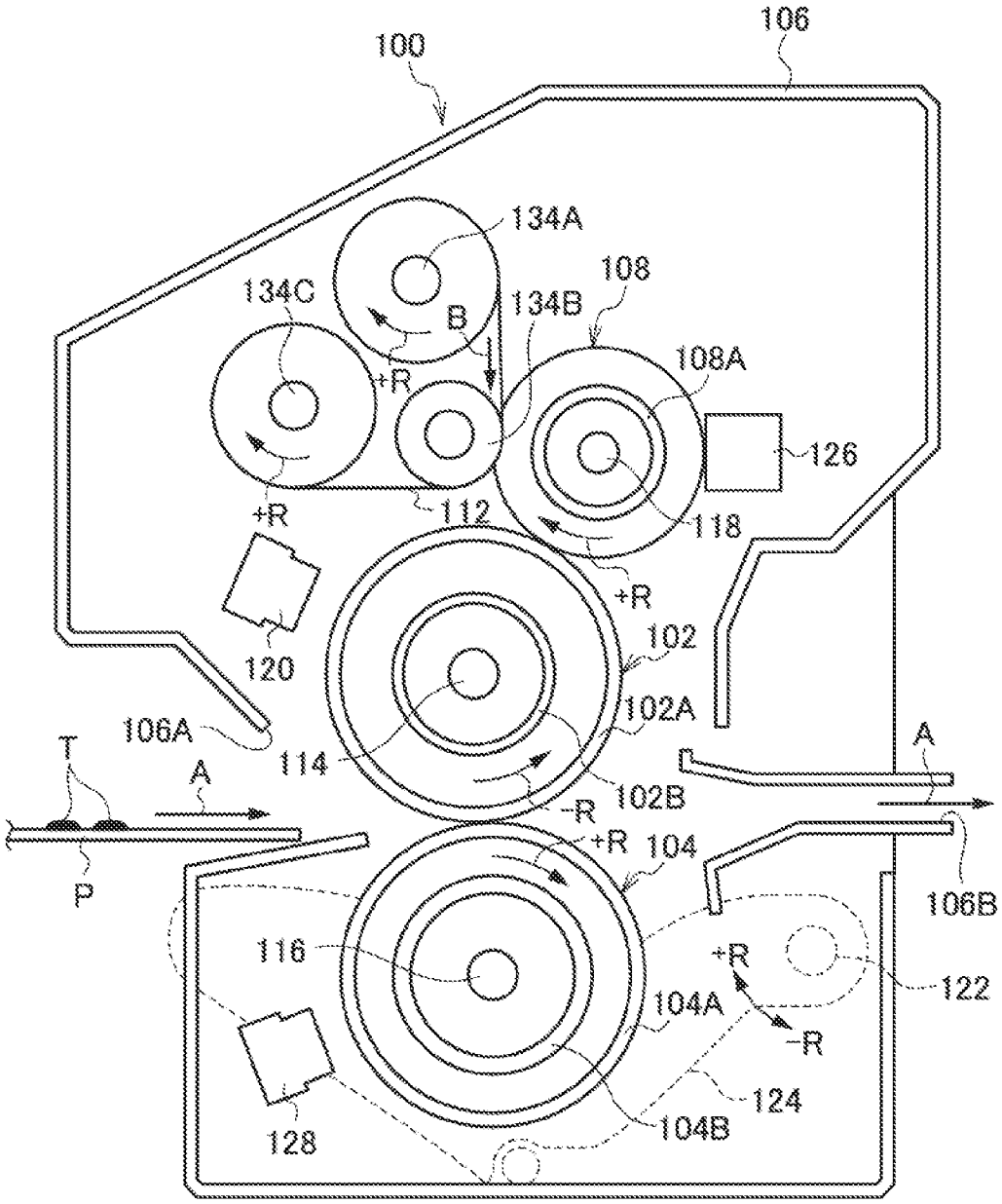
FIG. 3 is a configuration diagram of a fixing device according to an exemplary embodiment of the present invention.

As shown in FIG. 3, the fixing device 100 includes a casing 106 formed with an opening 106A into which the recording paper P is introduced and an opening 106B from which the recording paper P is discharged. Provided as main components inside the casing 106 are: a fixing roll 102, serving as an example of a heating (fixing) member, for applying heat to toner images (developer images) and fixing them to the recording paper P; a press roll 104, serving as an example of a pressing member, the press roll 104, together with the fixing roll 102, nipping the recording paper P and applying pressure to the recording paper P; an external heating roll 108, serving as an example of an external heating member, for making contacting with the outer surface of the fixing roll 102 and applying heat thereto; and a retraction mechanism 140 (see FIG. 4), serving as an example of a moving section, that moves the external heating roll 108 towards and away from the outer surface of the fixing roll 102.

The fixing roll 102 is disposed on the conveying path of the recording paper P on the toner face side (above). As an example, the fixing roll 102 is configured with a metal core 102B formed in a circular cylindrical shape from aluminum, covered with a resilient member 102A formed from a silicone rubber on the outer periphery of the metal core 102B, and with a release layer (not shown in the drawings) formed from a fluororesin on the outer surface of the resilient member 102A. A halogen heater 114 is provided inside the metal core 102B as a heat source in a non-contact state to the inner surface of the metal core 102B. The halogen heater 114 is configured so as to generate heat by electrical continuity with a power source (not shown in the drawings), and to heat the fixing roll 102 as a whole by heating the metal core 102B.

A first temperature sensor 120 for detecting the temperature of the fixing roll 102 is provided at a position facing the outer surface of the fixing roll 102 in the vicinity of the opening 106A side of the fixing roll 102, and a refresh roll 132 for leveling the outer surface of the fixing roll 102 is provided. The first temperature sensor 120 is a non-contact temperature sensor, and is configured so as to detect the temperature of the fixing roll 102 by receiving heat emitted from the fixing roll 102 with a infrared film, and detecting any rise in the temperature of this film using a thermistor.

The external heating roll 108 is, for example, configured as a circular cylinder of aluminum, with circular cylindrical shaped shaft portions 108A provided at the two length direction ends thereof. A halogen heater 118 is provided inside the external heating roll 108, acting as a heat source in a non-contact state with the inner surface of the external heating roll 108. The halogen heater 118 generates heat by electrical continuity with a power source (not shown in the drawings) and, for example, performs heating such that the temperature of the external heating roll 108 is 50° C. to 70° C. higher than the temperature of the fixing roll 102.

The external heating roll 108 is provided facing the outer surface of the fixing roll 102, and is moved by operation of the retraction mechanism 140 (see FIG. 4), described below, so as to capable of making contact with the outer surface of the fixing roll 102 or moving away from the outer surface. A second temperature sensor 126 of a contact type is provided to the outer surface of the external heating roll 108 for detecting the temperature of the external heating roll 108. A web 112 is provided so as to make contact with the outer surface of the external heating roll 108 and supply oil thereto.

The web 112 is a fiber body for cleaning the outer surface of the external heating roll 108 and is pre-impregnated with oil that acts as a lubricant to reduce the frictional force from contact with the external heating roll 108. The web 112 is wound around the periphery of a shaft 134A provided so as to be capable of rotation in the arrow +R direction. An intermediate roll 134B is rotatably disposed below the shaft 134A, and a shaft 134C is disposed so as to be capable of rotation in the arrow +R direction at the left hand side of the intermediate roll 134B and with a separation to the intermediate roll 134B.

By winding the web 112 around the outer surface of the intermediate roll 134B and fixing the leading end of the web 112 to the shaft 134C, the web 112 is wound up onto the shaft 134C while being gradually unwound from the shaft 134A. Configuration is made such that, by the shaft 134C being rotationally driven by a motor (not shown in the drawings) in the arrow +R direction, the web 112 moves in the arrow B direction, makes contact with the outer surface of the external heating roll 108, and is wound onto the shaft 134C. The web 112 is configured so as to be wound as required during fixing operation of the fixing device 100.

The press roll 104 is disposed on the conveying path of the recording paper P below the fixing roll 102. The press roll 104 is configured, for example, with a metal core 104B formed from circular cylindrical shaped aluminum and a resilient member 104A formed from a silicone rubber covering the outer periphery of the metal core 104B, and a release layer (not shown in the drawings) formed from a fluororesin formed on the outer surface of the resilient member 104A. A halogen heater 116 is provided at the inside of the metal core 104B and acts as a heat source in a non-contact state with the inner surface of the metal core 104B. The halogen heater 116 generates heat on electrical continuity with a power source (not shown in the drawings) and is configured to heat the press roll 104 as a whole by heating the metal core 104B.

A third temperature sensor 128 is provided at a position facing the outer surface of the press roll 104 and in the vicinity of the opening 106A side of the press roll 104, for detecting the temperature of the press roll 104. The third temperature sensor 128 is provided in a non-contact state with the press roll 104. The third temperature sensor 128 is configured similarly to the first temperature sensor 120. The first temperature sensor 120, the second temperature sensor 126 and the third temperature sensor 128 are connected to the control section 20 (see FIG. 1) and the control section 20 performs output to the halogen heaters 114, 116, 118 based on the input from the first temperature sensor 120, the second temperature sensor 126 and the third temperature sensor 128.

Bearings (not shown in the drawings) are provided at both ends of the press roll 104, with the bearings attached to a central portion of a substantially V-shaped bracket 124. The bracket 124 is provided so as to be able to swing under operation of an eccentric cam (not shown in the drawings) in the arrow +R direction and the arrow −R direction about a shaft 122 attached to the casing 106. The press roll 104 makes contact with the fixing roll 102 by the bracket 124 moving in the arrow +R direction, and the press roll 104 is separated from the fixing roll 102 by the bracket 124 moving in the arrow −R direction.

Explanation now follows regarding the retraction mechanism 140 of the external heating roll 108.

Figure 4:
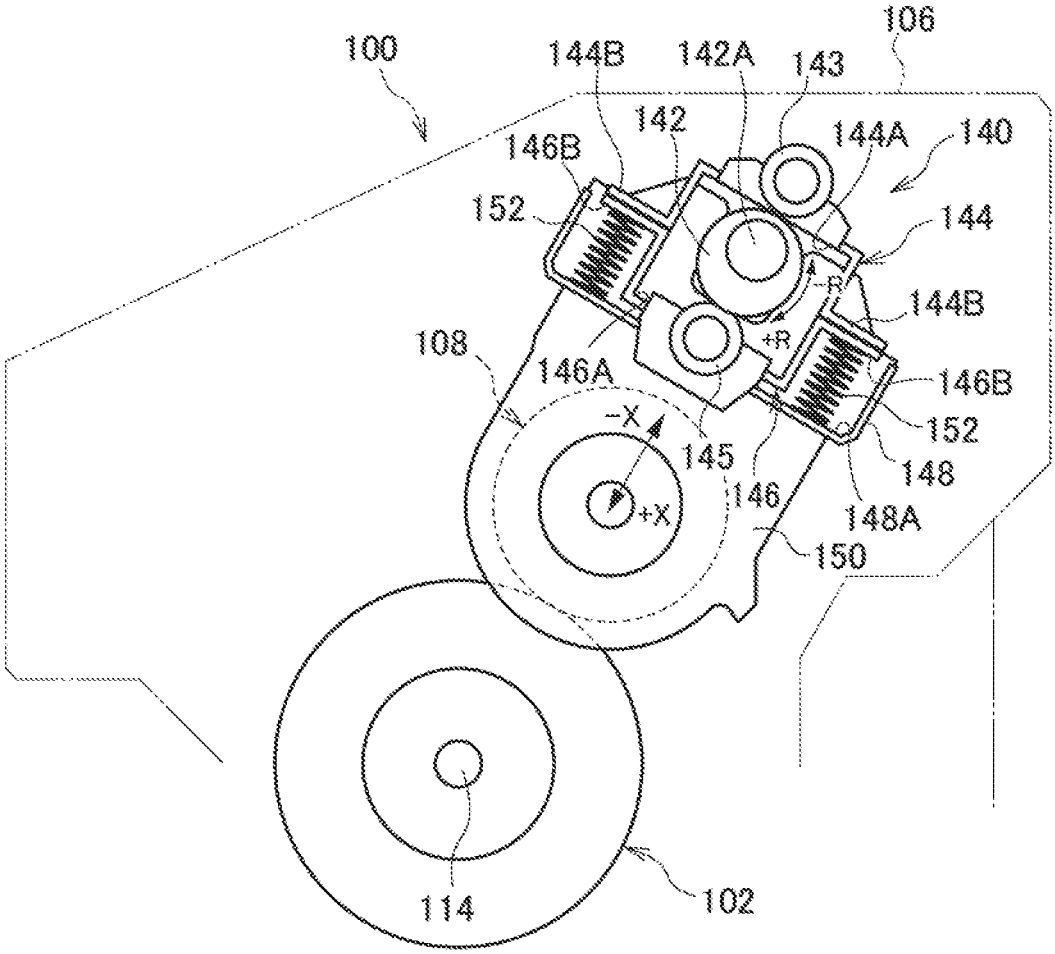
FIG. 4 is an explanatory diagram showing a mechanism for retracting an external heating roll, according to an exemplary embodiment of the present invention.

As shown in FIG. 4, the retraction mechanism 140 is configured to include: an eccentric cam 142; an upper bracket 144 and a lower bracket 146 provided so as to be disposed on either side of the eccentric cam 142; a support bracket 150 that supports two end portions in the axial direction of the external heating roll 108 and has a flange 148 disposed facing the lower bracket 146; and plural springs 152 having one end attached to the lower bracket 146 and the other end attached to the flange 148. Note that in the explanation that follows, the direction in which the external heating roll 108 approaches the fixing roll 102 is denoted the +X direction, and the direction in which the external heating roll 108 separates from the fixing roll 102 is denoted the −X direction. The +X direction and the −X direction are directions sloping down to the left and up to the right, respectively, in the drawing.

The eccentric cam 142 includes a rotation axis 142A having an axial direction that is the same as the axial direction of the external heating roll 108. The eccentric cam 142 is configured to be rotationally driven in the arrow +R direction (the clockwise direction in the drawings) or the arrow −R direction (the anti-clockwise direction in the drawings) by driving a motor (not shown in the drawings) under control from the control section 20 (see FIG. 1). Rotation of the eccentric cam 142 may be by either successive driving, in which rotation is successively in the same direction, or by switch-driving in which, after first driving in a given direction, rotation is then reversed to the other direction.

A recessed portion 144A is formed at the center of the upper bracket 144 in a U-shape in cross-section when viewed along the external heating roll 108 axial direction, and flat portions 144B are formed facing towards the outside from edge portions of the recessed portion 144A (the outside in a direction orthogonal to the arrow X direction). The upper bracket 144 is disposed further to the −X direction side than the eccentric cam 142, and the open side of the recessed portion 144A is disposed facing the eccentric cam 142. The upper bracket 144 is provided with an upper follower 143 rotatably provided to the recessed portion 144A. The upper follower 143 rotates by making contact with the outer surface of the eccentric cam 142.

A recessed portion 146A is formed at the center of the lower bracket 146 in a U-shaped in cross-section when viewed along the external heating roll 108 axial direction, and flat portions 146B are formed facing towards the outside from edge portions of the recessed portion 146A (the outside in a direction orthogonal to the arrow X direction). The lower bracket 146 is disposed further to the +X direction side than the eccentric cam 142, and the open side of the recessed portion 146A is disposed facing the eccentric cam 142. The lower bracket 146 is provided with a lower follower 145 rotatably provided to the recessed portion 146A. The lower follower 145 rotates by making contact with the outer surface of the eccentric cam 142.

The upper bracket 144 and the lower bracket 146 are connected together so as to sandwich the eccentric cam 142 between the recessed portion 144A and the recessed portion 146A, and are fastened together by nuts and bolts (not shown in the drawings) in a state in which the flat portions 144B and the flat portions 146B make contact. The center of rotation of the eccentric cam 142, the center of rotation of the upper follower 143, and the center of rotation of the lower follower 145 are disposed so as to fall on the same line in the arrow X direction. Note that the upper bracket 144 and the lower bracket 146 are restricted in movement direction to only the +X direction and the −X direction by guide members (not shown in the drawings).

The support bracket 150 has a bearing (not shown in the drawings) attached and rotatably supports the external heating roll 108 with the bearing. Note that a pair of the support brackets 150 is provided at the two ends of the external heating roll 108, with only one of which illustrated and explained. The movement direction of the support bracket 150 is restricted to only the +X direction and −X direction by guide members (not shown in the drawings). The flange 148 of the support bracket 150 is formed projecting out from the support bracket 150 in the external heating roll 108 axial direction, and is U-shaped in cross-section when viewed along the external heating roll 108 axial direction. The flange 148 is disposed such that the open side thereof faces towards the lower bracket 146. The springs 152 have an extension and compression direction along the arrow X direction, and one end thereof is fixed to the flat portions 146B of the lower bracket 146 and the other end to a flat portion 148A of the flange 148.

In the retraction mechanism 140, when the eccentric cam 142 and the lower follower 145 make contact and the upper bracket 144 and the lower bracket 146 move in the +X direction, the springs 152 bias the flange 148 in the +X direction. Accordingly, the support bracket 150 moves in the +X direction and the external heating roll 108 makes contact with the outer surface of the fixing roll 102. When the eccentric cam 142 and the upper follower 143 make contact and the upper bracket 144 and the lower bracket 146 move in the −X direction, force acts in the direction to compress the springs 152, and the flange 148 is pulled in the −X direction. Accordingly, the support bracket 150 moves in the −X direction and the external heating roll 108 separates (moves away) from the outer surface of the fixing roll 102. Namely, the retraction mechanism 140 is configured to switch between a contact and a non-contact state of the external heating roll 108 to the fixing roll 102.

Explanation now follows regarding setting the point in time the external heating roll 108 contacts the fixing roll 102.

Figure 5A:
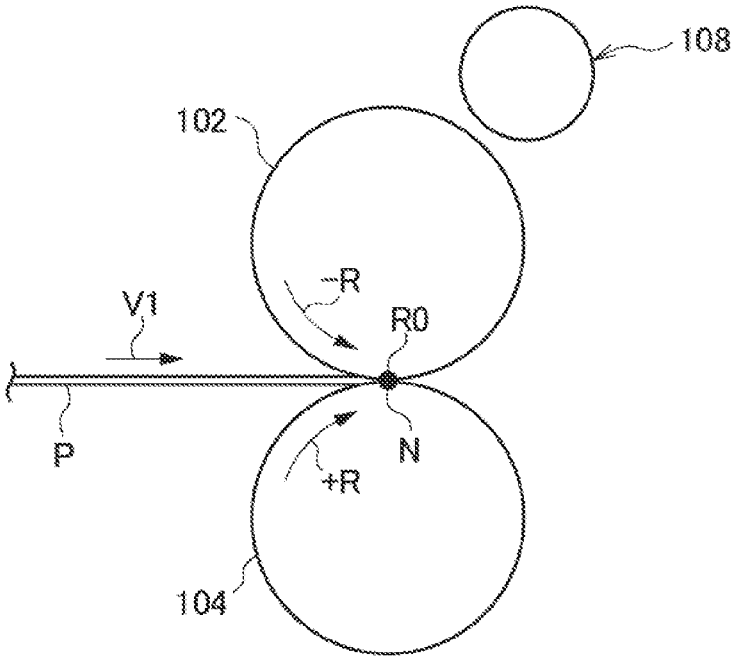
FIG. 5A and FIG. 5B are explanatory diagrams showing respective states in which an external heating roll is separated from a fixing roll, and contacts the fixing roll, according to an exemplary embodiment of the present invention.

As shown in FIG. 5A, for example, consider a case in which the fixing roll 102 and the press roll 104 are rotated with a peripheral speed V1, and recording paper P is introduced at a movement speed V1 into a contact portion N (nip portion) where the fixing roll 102 and the press roll 104 make contact. The computed contact position of the leading edge of the recording paper P on the outer surface of the fixing roll 102 is denoted R0. In such a case the external heating roll 108 is in a non-contact state to (moved away state from) the outer surface of the fixing roll 102 due to the retraction mechanism 140 (see FIG. 4).

Figure 5B:
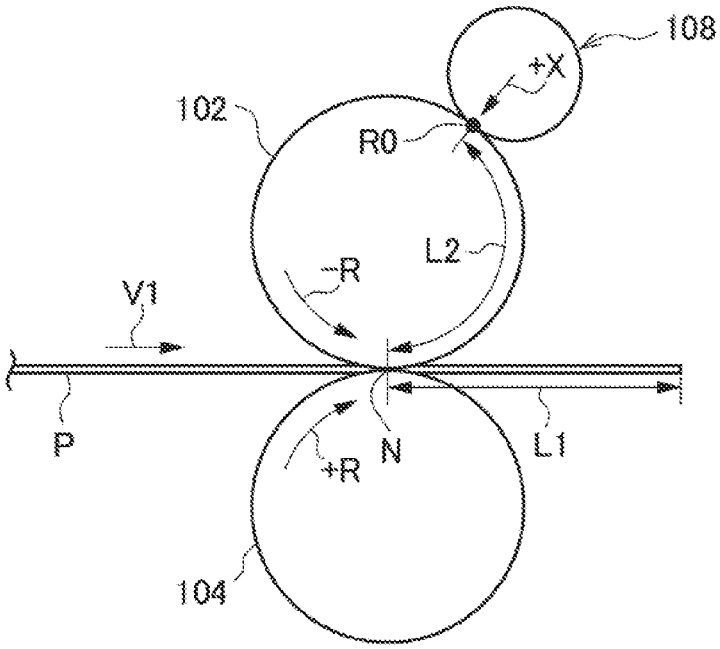

Then, as shown in FIG. 5B, the external heating roll 108 is configured to start contacting the outer periphery of the fixing roll 102 at the contact position R0 by the control section 20 (see FIG. 1) driving the retraction mechanism 140 (see FIG. 4). Namely, the contact position R0 is made the contact start position of the external heating roll 108, and the external heating roll 108 makes contact with the outer surface of the fixing roll 102 from the contact start position (R0) onwards.

When this is occurring, a separation distance L1 between the leading edge position of the recording paper P to the contact portion N along the movement direction is equivalent to a separation distance L2 from the contact position R0 to the contact portion N around the outer periphery of the fixing roll 102 (L1=L2). Namely, the external heating roll 108 is contacted against the outer periphery of the fixing roll 102 at when time t1=L1/V 1 has elapsed from the point in time when the leading edge of the recording paper P was introduced into the contact portion N. Note that the point in time when the leading edge position of the recording paper P was introduced into the contact portion N can be derived using t2=L3/V1 from the distance L3 (not shown in the drawings) from the paper sensors 91 to the contact portion N, and the point in time t2 that the leading edge of the recording paper P has passed the paper sensors 91. The external heating roll 108 accordingly makes contact with the outer periphery of the fixing roll 102 from the contact position R0, corresponding to the leading edge position of the recording paper P detected by the paper sensors 91, onwards.

Explanation now follows regarding changing the setting of the movement speed of the intermediate transfer belt 68 and the fixing roll 102 in the image forming apparatus 10.

Figure 6A:
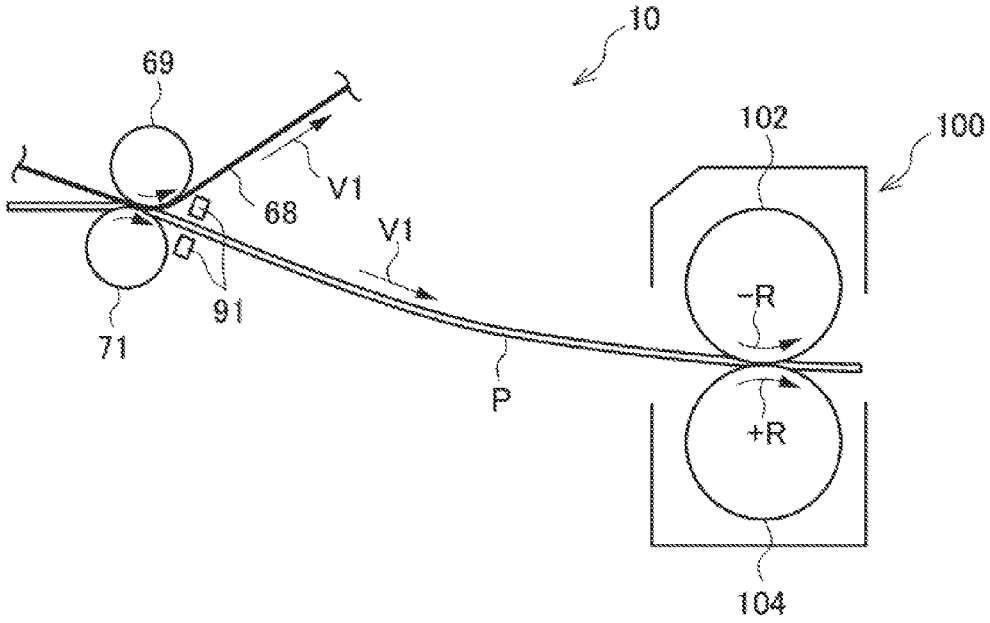
FIG. 6A and FIG. 6B are explanatory diagrams for showing a state at which the conveying speed of a recording paper is changed in a fixing device according to an exemplary embodiment of the present invention.

As shown in FIG. 6A, in a state in which the leading edge portion of the recording paper P is introduced into the contact portion between the fixing roll 102 and the press roll 104, and the trailing edge portion of the recording paper P is introduced into the contact portion of the intermediate transfer belt 68 and the secondary transfer roll 71 (the secondary transfer position QB (see FIG. 2), setting is made in the control section 20 (see FIG. 1) of the image forming apparatus 10 to drive the intermediate transfer belt 68 and the fixing roll 102 such that the movement speed of the intermediate transfer belt 68 and the peripheral speed of the fixing roll 102 are both V1.

Figure 6B:
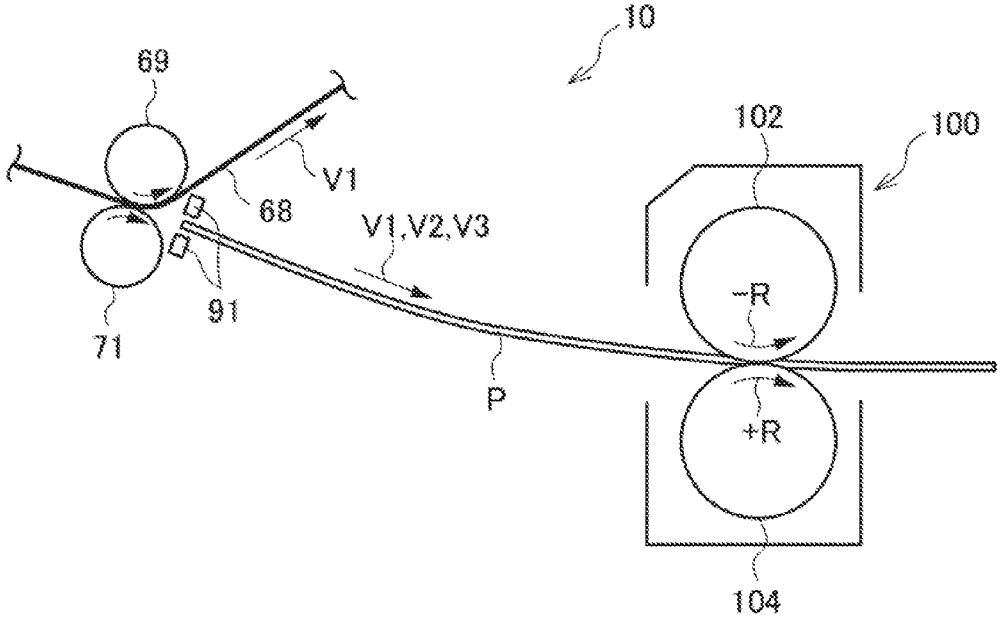

As shown in FIG. 6B, in a state in which the leading edge portion of the recording paper P is introduced into the contact portion between the fixing roll 102 and the press roll 104, and the trailing edge portion of the recording paper P is in a separated state from the contact portion of the intermediate transfer belt 68 and the secondary transfer roll 71, configuration is made such that the control section 20 (see FIG. 1) of the image forming apparatus 10 continues to drive the intermediate transfer belt 68 still at the movement speed of V1, while being able to set one or other of speeds of V1, V2 (<V1), or V3 (>V1) for the peripheral speed of the fixing roll 102. In this state, since the trailing edge portion of the recording paper P being conveyed is separated from the contact portion of the intermediate transfer belt 68 and the secondary transfer roll 71, deformation of the recording paper P by sagging or stretching is suppressed even if the movement speed of the intermediate transfer belt 68 and the peripheral speed of the fixing roll 102 are different from each other.

Configuration is made such that when the paper sensors 91 have detected that the trailing edge of the recording paper P has exited from the contact portion of the intermediate transfer belt 68 and the secondary transfer roll 71, changes are made to the peripheral speed of the fixing roll 102 as required. For example, control is performed such that the peripheral speed of the fixing roll 102 is decelerated from V1 to V2 when the fixing roll 102 starts its third rotation after the point in time when the leading edge of the recording paper P has entered the contact portion N between the fixing roll 102 and the press roll 104.

Explanation now follows regarding operation of the present exemplary embodiment.

Figure 7:
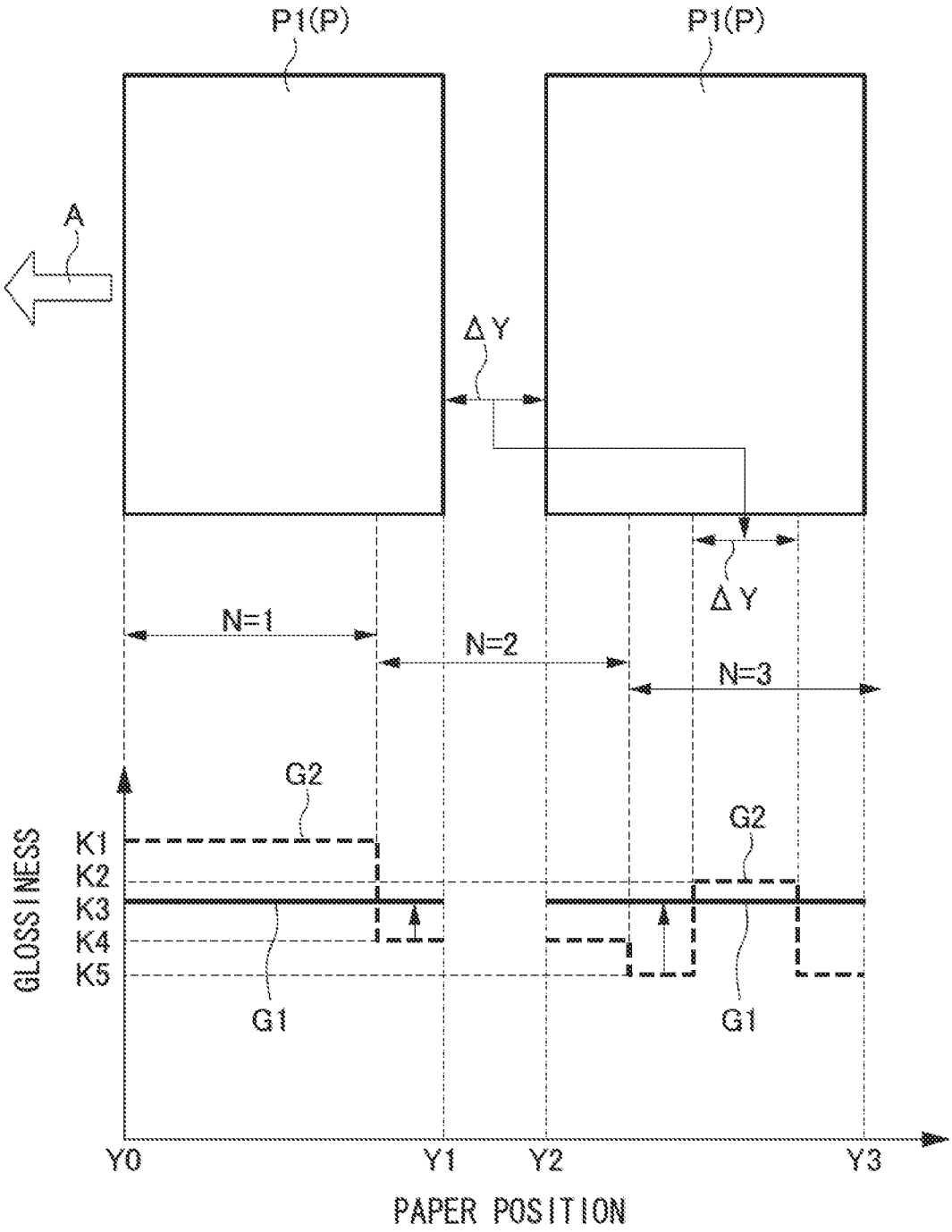
FIG. 7 is a schematic diagram showing an improved state of glossiness when two A4 sized sheets of recording paper have been successively fixed using a fixing device according to an exemplary embodiment of the present invention.

FIG. 7 shows, as an example, a schematic graph of recording paper P1 that is A4 size recording paper P for a case in which toner images (not shown in the drawings) are fixed in succession onto two sheets of the recording paper P1. The graph shows the glossiness of the toner images after fixing onto each of the sheets of recording paper P1. Graph G1 shown by the solid lines results from performing toner image forming and fixing with the image forming apparatus 10 (see FIG. 1) of the present exemplary embodiment. Graph G2 shown by the broken lines results from a comparative example, described below.

In FIG. 7, the first rotation of the fixing roll 102 is indicated by N=1, the second rotation by N=2, and the third rotation by N=3. The conveying separation between the two sheets of recording paper P1 is indicated by ΔY, the paper leading edge position of the first sheet of recording paper P1 is indicated by Y0, the paper trailing edge position of the first sheet of recording paper P1 is indicated by Y1, the paper leading edge position of the second sheet of recording paper P1 is indicated by Y2, and the paper trailing edge position of the second sheet of recording paper P1 is indicated by Y3. Note that the glossiness is the glossiness (units: %) of the toner images after fixing, and, for example, is obtained from measuring with a reflection glossmeter.

Explanation follows regarding changes in glossiness that occur during fixing with an image forming apparatus of a comparative example.

The image forming apparatus (fixing device) of the comparative example is configured to perform fixing with the external heating roll 108 (see FIG. 3) always in contact with the fixing roll 102, and with the velocity at the contact portion N constant at V1. In the image forming apparatus (fixing device) of the comparative example, due to the external heating roll 108 always being in contact with the fixing roll 102, there is an excessive amount of heat supplied at the fixing start time in comparison to independent heating of the fixing roll 102, and the temperature of the fixing roll 102 at the fixing start time is raised to higher than the set temperature. Therefore the glossiness at the paper leading edge position Y0 of the recording paper P1 is K1.

Then, in fixing the first sheet of recording paper P1, during the first revolution of the fixing roll 102, the heat of the fixing roll 102 is taken away by the recording paper P1, and the temperature of the fixing roll 102 falls. An amount of heat is replenished to the fixing roll 102 from the external heating roll 108 due to the external heating roll 108 always being in contact with the fixing roll 102. However, the degree by which the temperature of the fixing roll 102 is raised is small due to the temperature of the external heating roll 108 itself having fallen due to heat already having been supplied from the external heating roll 108 to the fixing roll 102 at the fixing start time.

Then, during the second revolution of the fixing roll 102 in the comparative example, the fixing roll 102 whose temperature has fallen during the first revolution makes contact with the trailing edge portion of the recording paper P1. Accordingly, the glossiness of the trailing edge portion of the recording paper P1 (including the paper trailing edge position Y1) falls from K1 to K4 (<K1). Note that between the first sheet of recording paper P1 and the second sheet of recording paper P1, the heat of the fixing roll 102 is not taken away by the recording paper P1 since the fixing roll 102 does not make contact with either sheet of the recording paper P1.

Then, during fixing the second sheet of recording paper P1 in the comparative example, due to the paper leading edge position Y2 being fixed partway through the second revolution of the fixing roll 102, the glossiness of the toner image is K4. During the second revolution of the fixing roll 102, heat of the fixing roll 102 is taken away by the trailing edge portion of the first sheet of the recording paper P1 and the leading edge portion of the second sheet of recording paper P1, and since the amount of heat replenished from the external heating roll 108 is small, the temperature of the fixing roll 102 falls, and the glossiness of the toner image falls from K4 to K5 (<K4). While the fixing roll 102 is partway through its second revolution, due to the heat not being taken away during the conveying separation ΔY there is a region in which the temperature rises, so the drop from the glossiness K4 to K5 is a lesser degree than the drop from the glossiness K1 to K4.

Then, during the third revolution the fixing roll 102 in the comparative example, the fixing roll 102 whose temperature has fallen during the second revolution makes contact with the second sheet of recording paper P1. Accordingly, the glossiness of the toner image up to the trailing edge portion of the second sheet of recording paper P1 (including the paper trailing edge position Y3) is fundamentally K5. However, from an intermediate position on the second sheet of recording paper P1 up to the trailing edge portion, in the region corresponding to the conveying separation ΔY, since the temperature of the position of contact of the outer surface of the fixing roll 102 does not fall, for example, the glossiness of the toner image rises to K2 (K1>K2>K4).

Accordingly, there is a large unevenness in glossiness when the toner images are inspected due to the glossiness of the toner images in the comparative example varying greatly, from K1, to K4, to K5, to K2, to K5, during the first revolution to the third revolution of the fixing roll 102.

Explanation now follows regarding changes to the glossiness when fixing is performed with the image forming apparatus 10 of the present exemplary embodiment.

As shown in FIG. 7, in the image forming apparatus 10 (the fixing device 100) of the present exemplary embodiment, since the external heating roll 108 does not make contact with the fixing roll 102 at the fixing start time, supply of an excessive amount of heat is suppressed at fixing start time in comparison to the comparative example, and the temperature of the fixing roll 102 is closer to the predetermined target temperature. Consequently, the glossiness of the toner image at the paper leading edge position Y0 of the recording paper P1 is K3 (wherein, for example, K2>K3>K4).

Then, when fixing the recording paper P1 in the first revolution of the fixing roll 102, due to fixing being performed with a region in which the external heating roll 108 has not been in contact, the glossiness of the toner image continues at a value close to K3. Then, during the first revolution of the fixing roll 102, since the external heating roll 108 makes contact for the region onwards from the contact position R0 where the leading edge of the recording paper P made contact, as shown in FIG. 5B, an amount of heat from the external heating roll 108 is replenished to the region the fixing roll 102 where heat was taken away by the recording paper P. The temperature of the fixing roll 102 thereby returns to the temperature prior to heat being taken away by the recording paper P. Then, as shown in FIG. 7, in a range on the recording paper P1 (including the paper trailing edge position Y1) corresponding of the second revolution of the fixing roll 102, the glossiness of the toner image is maintained at a value in the vicinity of K3.

Then, when fixing the second sheet of recording paper P1, due to the paper leading edge position Y2 being fixed when the fixing roll 102 is partway through its second revolution, the glossiness of the toner image remains at K3. Then, during the second revolution of the fixing roll 102, an amount of heat of the fixing roll 102 is taken away by the trailing edge portion of the first sheet of recording paper P1 and the leading edge portion of the second sheet of recording paper P1, and since the amount of heat replenished from the external heating roll 108 is small, the temperature of the fixing roll 102 would fall off.

However, in the present exemplary embodiment, during the third revolution of the fixing roll 102, the control section 20 (see FIG. 1) changes the peripheral speed of the fixing roll 102 after detecting, based on the output from the paper sensors 91, that the paper trailing edge position Y3 of the second sheet of recording paper P1 has exited the secondary transfer roll 71 (see FIG. 2). For example, during the third revolution of the fixing roll 102, in the region excluding the region corresponding to the conveying separation ΔY, the peripheral speed is decelerated from that of the first and second revolutions to a speed V2, thereby increasing the amount of heat applied to the toner image. During the third revolution of the fixing roll 102, for the region corresponding to the conveying separation ΔY, the peripheral speed is accelerated from that of the first and second revolutions to speed V3, so that excessive heat is not applied to the toner image. Thereby, the glossiness of the toner image up to the trailing edge portion of the second sheet of recording paper P1 (including paper trailing edge position Y3) is maintained at a value in the vicinity of K3.

Accordingly, in the image forming apparatus 10 (the fixing device 100) of the present exemplary embodiment, by matching the contact position of the external heating roll 108 to the position on the fixing roll 102 of the leading edge of the recording paper P1, in the first sheet of recording paper P1, the variation in the glossiness of the toner image is smaller than that in the comparative example, suppressing unevenness of glossiness. Furthermore, by changing the speed of the fixing roll 102, for the second sheet of recording paper P1, the variation in the glossiness of the toner image is smaller than in the comparative example, suppressing unevenness of glossiness.

Figure 8:
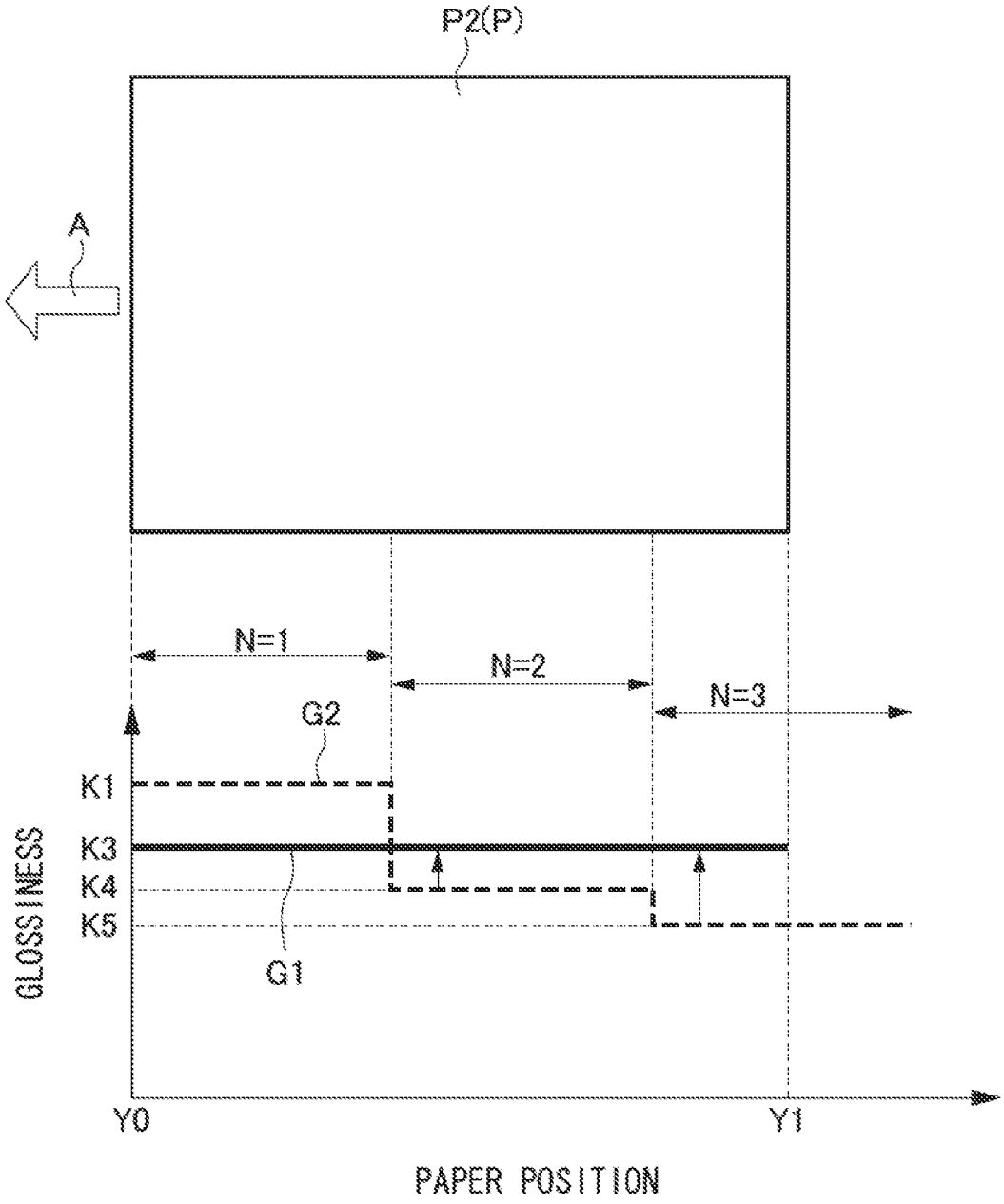
FIG. 8 is a schematic diagram showing an improved state of glossiness when one A3 sized sheet of recording paper has been fixed using a fixing device according to an exemplary embodiment of the present invention.

As another example, FIG. 8 is a schematic graph of recording paper P2 that is A3 size recording paper P for a case in which a toner image (not shown in the drawings) is fixed on one sheet of the recording paper P2, showing the glossiness of the toner images after fixing onto the sheet of recording paper P2. Graph G1 shown by the solid line results from performing toner image forming and fixing with the image forming apparatus 10 (see FIG. 1) of the present exemplary embodiment. Graph G2 shown by the broken line results from a comparative example.

In FIG. 8, the first rotation of the fixing roll 102 is indicated by N=1, the second rotation by N=2, and the third rotation by N=3. The paper leading edge position of the recording paper P2 is indicated by Y0 and the paper trailing edge position of the recording paper P2 is indicated by Y1.

Explanation follows regarding the glossiness for recording paper P2 occurring during fixing with the image forming apparatus of the comparative example.

The image forming apparatus (fixing device) of the comparative example is configured to perform fixing with the external heating roll 108 (see FIG. 3) always making contact with the fixing roll 102, and with the velocity at the contact portion N constant at V1. In the image forming apparatus (fixing device) of the comparative example, due to the external heating roll 108 always making contact with the fixing roll 102, there is an excessive amount of heat supplied at the fixing start time in comparison to independent heating of the fixing roll 102, and the temperature of the fixing roll 102 at the fixing start time rises higher than the set temperature. Therefore the glossiness at the leading edge portion of the recording paper P2 (including paper leading edge position Y0) is K1.

Then, during fixing of the recording paper P2, during the first revolution of the fixing roll 102, an amount of heat of the fixing roll 102 is taken away by the recording paper P2, and the temperature of the fixing roll 102 falls. Heat is replenished from the external heating roll 108 to the fixing roll 102 due to the external heating roll 108 always being in contact with the fixing roll 102. However, the degree by which the temperature of the fixing roll 102 is raised is small due to the temperature of the external heating roll 108 itself having fallen due to heat already having been supplied from the external heating roll 108 to the fixing roll 102 at the fixing start time.

Then, during the second revolution of the fixing roll 102 in the comparative example, the fixing roll 102 whose temperature has fallen during the first revolution makes contact with a central portion of the recording paper P2. Accordingly, the glossiness of the central portion of the recording paper P2 falls from K1 to K4 (<K1). Then, during the second revolution of the fixing roll 102, an amount of heat of the fixing roll 102 is taken away by the central portion of the recording paper P2, and since the amount of heat replenished from the external heating roll 108 is small, the temperature of the fixing roll 102 falls, and the glossiness of the toner image falls from K4 to K5 (<K4).

Then, during the third revolution of the fixing roll 102, the fixing roll 102 whose temperature has fallen during the second revolution makes contact with the trailing edge portion of the recording paper P2. Accordingly, the glossiness of the toner image up to the trailing edge portion of the recording paper P2 (including the paper trailing edge position Y1) is K5. Accordingly, in the comparative example, there is a large unevenness in glossiness when the toner images are inspected due to the glossiness of the toner images in the comparative example reducing in steps, from K1 to K4, to K5, from the first revolution to the third revolution of the fixing roll 102.

Explanation now follows regarding changes to the glossiness when fixing is performed for the recording paper P2 with the image forming apparatus 10 of the present exemplary embodiment.

As shown in FIG. 8, in the image forming apparatus 10 (the fixing device 100) of the present exemplary embodiment, since the external heating roll 108 does not make contact with the fixing roll 102 at the fixing start time, supply of an excessive amount of heat is suppressed at fixing start time in comparison to the comparative example, and the temperature of the fixing roll 102 is closer to the predetermined target temperature. Consequently, the glossiness of the toner image at the paper leading edge position Y0 of the recording paper P2 is K3 (wherein, for example, K1>K3>K4).

Then, when fixing the recording paper P2 in the first revolution of the fixing roll 102, due to fixing being performed in a region in which the external heating roll 108 has not been in contact, the glossiness of the toner image continues at a value close to K3. Then, as shown in FIG. 5B, during the first revolution of the fixing roll 102, since the external heating roll 108 makes contact with the fixing roll 102 for the region onwards from the contact position R0, where the leading edge of the recording paper P2 has made contact, an amount of heat is replenished from the external heating roll 108 to the fixing roll 102 in the region where the amount of heat was taken away by the recording paper P2. The temperature of the fixing roll 102 thereby returns to the temperature prior to heat being taken away by the recording paper P2. Then, as shown in FIG. 8, in a range on the recording paper P2 corresponding to the second revolution of the fixing roll 102, the glossiness of the toner image is maintained at a value in the vicinity of K3.

Then, when fixing the second sheet of recording paper P2 during the third revolution of the fixing roll 102, due an amount of heat of the fixing roll 102 having been taken away by the central portion of the recording paper P2 during the second revolution, and since the amount of heat replenished from the external heating roll 108 is small, the temperature of the fixing roll 102 would fall off.

However, in the present exemplary embodiment, the control section 20 (see FIG. 1) changes the peripheral speed of the fixing roll 102 during the third revolution after detecting, based on the output from the paper sensors 91 (see FIG. 1) that the paper trailing edge position Y1 of the recording paper P2 has exited the secondary transfer roll 71 (see FIG. 2). For example, the peripheral speed of the fixing roll 102 during the third revolution is decelerated from that of the first and second revolutions to a speed V2, thereby increasing the amount of heat applied to the toner image. Consequently, the glossiness of the toner image up to the trailing edge portion of the recording paper P2 (including paper trailing edge position Y1) is maintained at a value in the vicinity of K3.

Accordingly, in the image forming apparatus 10 (the fixing device 100) of the present exemplary embodiment, by matching the contact position of the external heating roll 108 to the fixing roll 102 to the position on the fixing roll 102 of the leading edge P2, the variation in the glossiness of the toner image from the leading edge portion to the central portion of the recording paper P2 is smaller than that in the comparative example, suppressing unevenness of glossiness. Furthermore, by changing the speed of the fixing roll 102 for the trailing edge portion of the recording paper P2, the variation in the glossiness of the toner image is smaller than in the comparative example, suppressing unevenness of glossiness.

The present invention is not limited by the above exemplary embodiments.

Configuration may be made with a fixing belt heating by electromagnetic inductance in place of the fixing roll 102. The types of recording paper P are not limited to A4 and A3 size, and other sizes may be employed. Further, configuration may be made such that the change over point for the speed change settings of the fixing roll 102 is varied according to the quality of the toner and/or the thickness of the recording paper P employed. Configuration may also be made with paper sensors 91 provided within the fixing device 100, so as to detect the leading edge position of the recording paper P.

Further, although the exemplary embodiment explains a configuration in which the external heating roll 108 is moved to the contact position R0 of the fixing roll 102 with the recording paper P and starts heating of the fixing roll 102, and the heating is terminated by the external heating roll 108 being moved away from the fixing roll 102, embodiments are not limited to this. For example, a configuration may be provided in which the external heating roll 108 is not be moved, and a controller controls the heating operation (ON/OFF) of the external heating roll 108 such that the external heating roll 108 starts heating of the fixing roll 102 from the contact position R0. In this case, the external heating roll 108 may perform heating of the fixing roll 102 without contacting the fixing roll 102.

What is claimed is:

1. A fixing device comprising:

a heating member that, while rotating, heats and fixes a developer image onto a recording medium;

a pressing member that nips and presses the recording medium between itself and the heating member;

an external heating member configured to make contact with an outer surface of the heating member and to move away from the outer surface of the heating member, the external heating member making contact with the outer surface of the heating member and heating the heating member; and a moving section that computes a contact position on the heating member where a leading edge of the recording medium contacts the outer surface of the heating member, and moves the external heating member such that the external heating member initially contacts the outer surface of the heating member on the computed contact position.

2. A fixing device comprising:

a heating member that, while rotating, heats and fixes a developer image onto a recording medium;

a pressing member that nips and presses the recording medium between itself and the heating member;

an external heating member configured to make contact with an outer surface of the heating member and to move away from the outer surface of the heating member, the external heating member making contact with the outer surface of the heating member and heating the heating member;

a detection section provided on a conveying path of the recording medium and detecting the recording medium; and a moving section that moves the external heating member such that the external heating member initially contacts the outer surface of the heating member at a position corresponding to a leading edge position of the recording medium derived according to a detection result of the detection section, wherein the leading edge position is a contact position on the heating member where a leading edge of the recording medium contacts the outer surface of the heating member.

3. An image forming apparatus comprising:

a developer image forming section that forms a developer image;

a transfer section that transfers the developer image formed by the developer image forming section onto a recording medium;

the fixing device of claim 2 that fixes the developer image transferred by the transfer section onto the recording medium; and a speed change section that changes a speed of the recording medium after the recording medium has been detected by the detection section, wherein the detection section detects that a trailing edge of the recording medium has passed the transfer section.

4. A fixing device comprising:

a heating member that, while rotating, heats and fixes a developer image onto a recording medium;

a pressing member that nips and presses the recording medium between itself and the heating member;

an external heating member that heats the heating member; and a controller that controls heating operation of the external heating member, the controller computing a contact position on the heating member where a leading edge of the recording medium contacts an outer surface of the heating member, and controlling the external heating member such that the external heating member initiates heating of the outer surface of the heating member from the computed contact position.

5. An image forming apparatus comprising:

a developer image forming section that forms a developer image;

a transfer section that transfers the developer image formed by the developer image forming section onto a recording medium;

a fixing section that heats and fixes the developer image onto the recording medium; and a controller that controls the fixing section and that changes a speed of the recording medium at the fixing section, wherein the fixing section comprises:

a heating member that, while rotating, heats the recording medium;

a pressing member that nips and presses the recording medium between itself and the heating member;

an external heating member configured to make contact with an outer surface of the heating member and to move away from the outer surface of the heating member, the external heating member making contact with the outer surface of the heating member and heating the heating member; and a moving section that comprises a detector that detects or computes a position of the recording medium, the moving section moving the external heating member such that the external heating member contacts a position of the outer surface of the heating member, which corresponds to a contact start position of the recording medium and the heating member, based on the detected or computed position of the recording medium, wherein the controller reduces a peripheral speed of the heating member after a trailing edge of the recording medium passes through the transfer section and after a time when the contact start position passes through a position where the heating member faces the pressing member, based on the detected or computed position of the recording medium.

* * * * *